US006349689B1

(12) United States Patent
Warwick et al.

(10) Patent No.: US 6,349,689 B1
(45) Date of Patent: Feb. 26, 2002

(54) TAPPET ASSEMBLY WITH A CERAMIC WEAR PAD

(75) Inventors: Michael J. Warwick, Columbus; Bryan E. Blackwell, Franklin, both of IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 09/551,540

(22) Filed: Apr. 18, 2000

(51) Int. Cl.[7] ..... F01L 1/14; F01L 1/16
(52) U.S. Cl. ..... 123/90.5; 123/90.51; 74/569
(58) Field of Search ..... 123/90.48, 90.49, 123/90.5, 90.51; 74/569

(56) References Cited

U.S. PATENT DOCUMENTS

| | | | | | |
|---|---|---|---|---|---|
| 3,470,983 | A | * | 10/1969 | Briggs | 184/6.9 |
| 4,367,701 | A | * | 1/1983 | Buente | 123/90.55 |
| 5,060,607 | A | | 10/1991 | Taniguchi | 123/90.51 |
| 5,168,841 | A | | 12/1992 | Suzuki et al. | 123/90.48 |
| 5,269,268 | A | * | 12/1993 | Hara | 123/90.48 |
| 5,372,099 | A | | 12/1994 | Matsunuma et al. | 123/90.48 |
| 5,400,749 | A | * | 3/1995 | Koizumi et al. | 123/90.51 |
| 5,445,119 | A | | 8/1995 | Regueiro | 123/90.48 |
| 5,542,315 | A | | 8/1996 | Carroll, III et al. | 74/586 |
| 5,570,665 | A | * | 11/1996 | Regueiro | 123/90.27 |
| 5,640,934 | A | * | 6/1997 | Mori | 123/90.52 |
| 5,662,076 | A | * | 9/1997 | Ohtsubo et al. | 123/90.51 |
| 5,921,210 | A | | 7/1999 | Regueiro | 123/90.22 |
| 5,922,479 | A | | 7/1999 | Taniguchi et al. | 428/673 |
| 5,934,236 | A | * | 8/1999 | Rao et al. | 123/90.51 |
| 5,943,990 | A | * | 8/1999 | Mori et al. | 123/90.51 |

* cited by examiner

*Primary Examiner*—Weilun Lo
(74) *Attorney, Agent, or Firm*—Nixon Peabody LLP; Charles M. Leedom, Jr; Daniel Song

(57) ABSTRACT

A tappet assembly for an internal combustion engine, the tappet assembly having a first end mechanically connected to a engine component and second end adapted to contact a cam lobe of a camshaft to displace the engine component, where the tappet assembly includes a tappet body having a recessed pocket positioned at one end thereof, the recessed pocket being defined by an extended peripheral lip of said tappet body, a ceramic wear pad at least partially received within the recessed pocket, and a mechanism for preventing the ceramic wear pad from rotating relative to the recessed pocket. The ceramic wear pad has a top surface for contacting the cam lobe, a bottom surface which is received in the recessed pocket, and a peripheral edge surface thereinbetween. In the preferred embodiment, the mechanism for preventing rotation of the ceramic wear pad includes at least one inwardly angled portion of the peripheral lip, the at least one inwardly angled portion being swaged radially inwardly toward an axial center of the ceramic wear pad to engage the peripheral edge surface of the ceramic wear pad.

31 Claims, 3 Drawing Sheets

TAPPET ASSEMBLY WITH A CERAMIC WEAR PAD

BACKGROUND OF THE INVENTION

1. Field of the Invention

The present invention is related to the field of tappets for internal combustion engines. More specifically, the invention relates to such tappet assemblies having a ceramic wear pad.

2. Description of Related Art

In internal combustion engines, camshafts with cam lobes are generally used to actuate various engine components such as valves and other related valve train components as well as fuel injectors. In particular, in engine valve trains, a tappet is generally provided to contact the cam lobe and to follow the cam lobe profile as the camshaft rotates. In this manner, the tappet is displaced and exerts a force to displace an engine component mechanically connected to the tappet such as a push rod, rocker arm or a valve.

Such valve train components are subject to high forces and stresses. In particular, the contact interface between the cam lobes and the tappets are subject to very high sliding contact stresses as the camshafts arc rotated and the cam lobes slide across the surface of the tappets to thereby displace the tappets. To ensure durability of the cam lobes and the tappets under these adverse operating conditions, these engine components are typically made of metals such as iron or steel or other strong materials that are durable enough for such applications. However, with increased engine performance requirements, the speed of rotation of the camshafts and the forces excited between the cam lobes and the tappets have increased correspondingly. As a result, the iron or steels typically used for the tappets have been found to be insufficient in allowing the increased engine performance. Moreover, the consumers of such engines have come to expect increased durability and minimal repair of these engines as well.

Consequently, various tappet assemblies with wear resistant ceramic pads have been created to allow increased engine performance and to meet the increased durability requirements. For instance, U.S. Pat. No. 5,060,607 to Taniguchi discloses a tappet assembly with a friction-resistant ceramic plate fixedly attached to an end of a tappet body. The reference discloses that the ceramic plate is made of silicon nitride or zirconia as well as other ceramics. The reference further discloses an alternative embodiment in which the ceramic plate is provided on a metallic plate which may be brazed on to the tappet body. It has been found that the ceramic plate made of such materials as silicon nitride or zirconia reduced friction between the cam lobe and the tappet assembly thereby reducing wear on both of these components and potentially provided a solution for meeting the increased performance and durability requirements.

However, concern exists that over a period of use, the ceramic plate as disclosed in Taniguchi would tend to separate and eventually slide off from the tappet body as the cam lobe exerts a sliding force on the ceramic plate's surface. Consequently, the tappet assembly with the ceramic plate as disclosed in Taniguchi has been found to be insufficient to allow increased engine performance and insufficient to meet the increased durability requirements.

To improve upon the tappet assembly disclosed in Taniguchi, U.S. Pat. No. 5,372,099 to Matsunuma et al. and U.S. Pat. No. 5,445,119 to Regueiro each disclose a ceramic shim for minimizing abrasion of a cam and a tappet which includes a recessed pocket formed by a lip of the tappet's peripheral wall for partially receiving the ceramic shim in the recessed pocket. The Matsunuma reference discloses a clearance between the ceramic shim and the tappet's peripheral wall. In contrast, the Regueiro reference discloses a dual-diameter shim with a small and large diameter cylindrical portions where only the small diameter cylindrical portion is received in the recess pocket of the tappet. It has been found that because of the recessed pocket formed by the lip of the tappets' peripheral wall, the ceramic shims were prevented from sliding off from the respective tappet body as the cam lobe exerts a sliding force on the ceramic plate's surface. Thus, the primary disadvantage of the tappet assembly disclosed in Taniguchi is eliminated.

However, the present applicants have found that the tappet assemblies with the ceramic shims disclosed in Matsunuma and Regueiro discussed above present unique problems of their own. In particular, it has been found that over a period of use, the ceramic shims may tend to rotate within the recessed pocket. This poses a significant durability and reliability concerns since the free rotation of the ceramic shim substantially reduces or even eliminates rotation of the tappet body within its mating bore in the cylinder block, this rotation of the tappet body being necessary for maximizing wear and scuffing resistance at that interface (i.e. the interface between the tappet body and the mating bore). More significantly, such free rotation within the recessed pocket can cause excessive wear on the lip of the tappet's peripheral wall and eventually cause the ceramic shim to slide off the tappet body which was the problem encountered in the tappet assembly disclosed in Taniguchi. Moreover, this tendency for rotation of the ceramic shim relative to and within the recessed pocket has been found to be exacerbated in diesel engine applications where soot particles accumulate on the contact surfaces of the cam lobe and the ceramic shim thereby increasing the coefficient of friction between these components. Thus, like the tappet assembly disclosed in Taniguchi, the tappet assemblies with the ceramic shims disclosed in Matsunuma and Regueiro have also been found to be insufficient to allow increased engine performance and insufficient to meet the increased durability requirements as well.

Therefore, there exists an unfulfilled need for a tappet assembly with a ceramic wear pad which will allow increased engine performance. There also exists an unfulfilled need for such a tappet with a ceramic wear pad which will increase durability of the tappet assembly.

BRIEF SUMMARY OF THE INVENTION

In view of the foregoing, it is an object of the present invention to provide an improved tappet assembly with a ceramic wear pad which will allow increased engine performance.

A second object of the present invention is to provide an improved tappet assembly with a ceramic wear pad which will provide increased durability of the tappet assembly.

Yet another object of the present invention is to provide a tappet assembly with a ceramic wear pad which will prevent the ceramic wear pad from sliding off from the tappet body.

Still further, it is an object of the present invention to provide a tappet assembly with a ceramic wear pad which will prevent the ceramic wear pad from rotating relative to the tappet body.

In accordance with preferred embodiments of the present invention, these objects are obtained by an improved tappet assembly for an internal combustion engine, the tappet assembly having a first end mechanically connected to an engine component and second end adapted to contact a cam lobe of a camshaft to displace the engine component, where the tappet assembly includes a tappet body having a recessed pocket positioned at one end thereof, the recessed pocket being defined by an extended peripheral lip of the tappet body, a ceramic wear pad at least partially received within the recessed pocket, the ceramic wear pad being adapted to contact the cam lobe, and a rotation prevention means for preventing the ceramic wear pad from rotating relative to the recessed pocket. The ceramic wear pad has a top surface for contacting the cam lobe, a bottom surface which is received in the recessed pocket, and a peripheral edge surface thereinbetween.

In accordance with one embodiment of the present invention, the rotation prevention means includes at least one inwardly angled portion of the peripheral lip, the at least one inwardly angled portion being swaged radially inwardly toward an axial center of the ceramic wear pad to engage the ceramic wear pad. The ceramic wear pad has at least one engagement surface on the peripheral edge surface and at least one inwardly angled portion engages the at least one engagement surface. Preferably, the at least one engagement surface is a plurality of engagement surfaces distributed along the peripheral edge surface and the at least one inwardly angled portion is a plurality of inwardly angled portions that engages the plurality of engagement surfaces.

In accordance with another embodiment of the present invention, the peripheral edge surface of the tappet assembly includes a beveled edge so that the top surface of the ceramic wear pad has a smaller diametric dimension than the bottom surface. The plurality of engagement surfaces are equidistantly distributed on the beveled edge. Thus, in this embodiment, the plurality of inwardly angled portions are swaged radially inwardly toward the axial center of said ceramic wear pad so as to engage the plurality of engagement surfaces on the beveled edge.

In accordance with yet another embodiment of the present invention, the rotation prevention means includes at least one substantially flat surface provided on the peripheral edge surface of the ceramic wear pad. A set screw threaded through a hole on the extended peripheral lip is provided to fixably engage at least one substantially flat surface on the peripheral edge surface of the ceramic wear pad. Of course, such provisions of a set screw may also be provided in other embodiments of the present invention as well. In another alternative embodiment, a weldment may be used instead or in conjunction with the set screw.

In still another embodiment of the present invention, the tappet assembly may further comprise an intermediary layer disposed in the recessed pocket between the bottom surface of the ceramic wear pad and a base surface of the recessed pocket. In one embodiment, this intermediary layer call be disposed solely between the ceramic wear pad and the tappet body. In another embodiment, the intermediary layer can extend around the sides of the ceramic wear pad to facilitate centering the ceramic wear pad within the recessed pocket. The intermediary layer may be an adhesive layer for adhering the bottom surface of the ceramic wear pad to the base surface of the recessed pocket. The adhesive layer may be made of epoxy or be formed of a dry polymer film which is adapted to be melted and resolidified. Alternatively, the intermediary layer may be a compliant layer made of a material which is more compliant than the tappet body and the ceramic wear pad. In this regard, the compliant layer may be a metallic sheet, a metallic shim, a wire mesh made of aluminum, copper or other ductile material such as a metal or an alloy, or be made of a polymer.

These and other objects, features and advantages of the present invention will become more apparent from the following detailed description of the preferred embodiments of the invention when viewed in conjunction with the accompanying drawings.

DETAILED DESCRIPTION OF THE INVENTION

Figure 1:
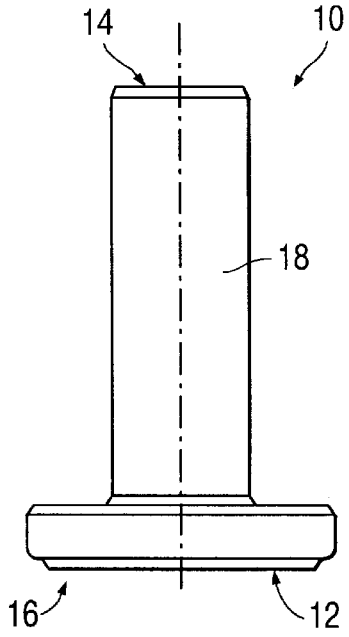
FIG. 1 is a front profile view of a tappet assembly in accordance with one embodiment of the present invention.

FIG. 1 illustrates a tappet assembly 10 with a ceramic wear pad 12 in accordance with one embodiment of the present invention which will allow increased engine performance and will increase the durability of the tappet assembly 10. As will be discussed in further detail below, the tappet assembly 10 overcomes the deficiencies of the prior art tappets by preventing the ceramic wear pad 12 from sliding off the tappet body while also preventing the ceramic wear pad 12 from rotating.

In accordance with the embodiment illustrated in FIG. 1, the improved tappet assembly 10 has a first end 14 which is adapted to be mechanically connected to an engine component such as a push rod, rocker arm, or a valve (not shown) for actuating a valve or an injector (not shown). A second end 16 is adapted to contact and follow a cam lobe of a camshaft (not shown) to thereby displace the engine component. It is noted that while in the illustrated embodiments of the present invention described, the tappet assembly 10 is adapted to be used in an OHV type engine and the first end 14 is adapted to mechanically engage a push rod, the present invention should not be construed to be limited to such an embodiment. The present invention may also be equally applied to tappet assemblies typically referred to as lifters in OHC type engines.

Figure 2:
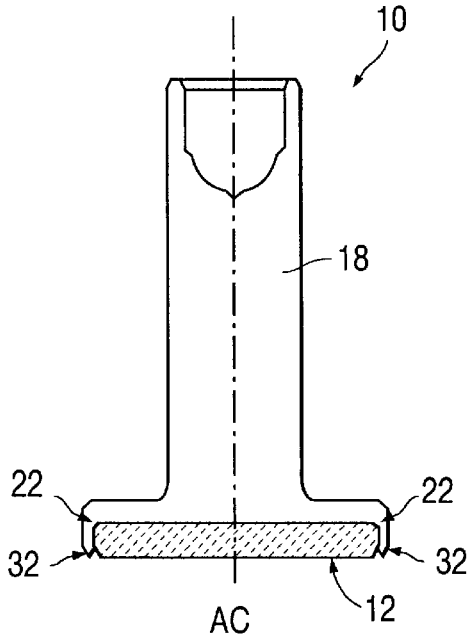
FIG. 2 is a cross-sectional view of the tappet assembly of FIG. 1.
Figure 3:
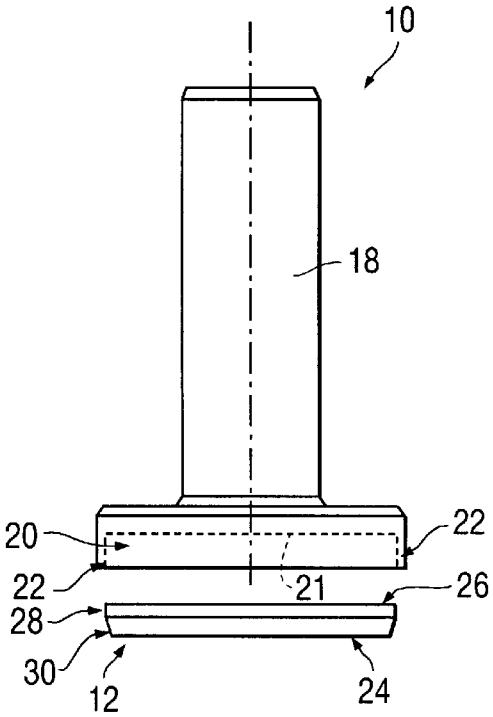
FIG. 3 is a pre-assembly schematic view of the tappet body and the ceramic wear pad in accordance with an embodiment of the present invention.

As can be seen more clearly in the cross-sectional view of FIG. 2 and the unassembled view of FIG. 3, the tappet assembly 10 includes a tappet body 18 having a recessed pocket 20 positioned at one end thereof, in this case, the second end 16. As shown in FIGS. 2 and 3, the recessed pocket 20 is defined by an extended peripheral lip 22 of the tappet body 10. In this regard, the tappet body 18 is preferably made of metal such as iron, steel, aluminum and/or other appropriate material. Because the extended peripheral lip 22 is relatively thin (as compared to other portions of the tappet body 18), the tappet body 10 should be made of a relatively strong material. At the same time, as will be discussed in further detail below, because in one embodiment of the present invention, the peripheral lip 22 is actually mechanically bent, the material should also be somewhat ductile. In this regard, steel has been found to be perform very well in this embodiment.

The ceramic wear pad 12 is at least partially received within the recessed pocket 20 in the manner shown in FIG. 2 so that the ceramic wear pad 12 provides a reduced friction, wear resistant surface upon which the cam lobe (not shown) contacts. In this regard, the ceramic wear pad 12 may be made of numerous commonly used ceramics having physical properties that will allow application in the operating environment described herein. In the illustrated embodiments, the ceramic wear pad 12 is preferably made of Zirconia or silicon nitride which have been found to perform very well in the present application. However, it should be understood that the term "ceramic" as used in the broad sense and is intended to encompass cermets as well.

The ceramic wear pad 12 in accordance with one embodiment of the present invention is illustrated in FIG. 3. As can be seen, the ceramic wear pad 12 is generally disk shaped and has a top surface 24 for contacting the cam lobe (not shown), a bottom surface 26 which is received in the recessed pocket 20 and contacts a base surface 21 of the recessed pocket 20, and a peripheral edge surface 28 thereinbetween. It should be noted that although in the illustrated embodiment, the peripheral edge surface 28 includes a beveled edge 30 so that the top surface 24 of the ceramic wear pad 12 has a smaller diametric dimension than the bottom surface 26, the beveled edge 30 may be absent in other embodiments of the invention. However, as will be discussed and will become evident below, the beveled edge 30 can provide a significant functional advantage over the prior art ceramic wear pads.

The tappet assembly 10 in accordance with the present invention also includes a rotation prevention means for preventing the ceramic wear pad 12 from rotating in the recessed pocket 20. By providing such a rotation prevention means, the deficiencies of the prior art tappet assemblies is eliminated thereby allowing increased engine performance and increased durability of the tappet assembly 10. In the illustrated embodiment of FIGS. 1 and 2, the rotation prevention means comprises the peripheral lip 22 which has been swaged radially inwardly toward an axial center AC of the ceramic wear pad 12 to thereby engage the ceramic wear pad 12. The rotation prevention means in accordance with this embodiment is best appreciated by comparing the peripheral lip 22 illustrated in FIG. 2 with the peripheral lip 22 of FIG. 3 which illustrates an unassembled view of the tappet assembly 10. As can be clearly seen in FIG. 2, the peripheral lip 22 has be swaged radially inwardly toward the axial center AC of the ceramic wear pad 12 so as to create an inwardly angled portion 32 that engages the ceramic wear pad 12 to thereby prevent rotation of the ceramic wear pad 12 relative to the recessed pocket 20. Moreover, as can be clearly seen in the illustrated embodiment, the peripheral edge surface 28 includes a beveled edge 30 which allows the peripheral lip 22 to be swaged so as to provide the inwardly angled portion 32 that engages the beveled edge 30 of the ceramic wear pad 12. Of course, it should be appreciated that preferably, the peripheral lip 22 is swaged radially inwardly all along its circumference so as to provide the inwardly angled portion 32 which surrounds and encapsulates the ceramic wear pad 12. However, it should also be appreciated that the inwardly angled portion 32 may be provided intermittently along the circumference of the peripheral lip 22 so as to engage the ceramic wear pad 12 intermittently as well.

Figure 4:
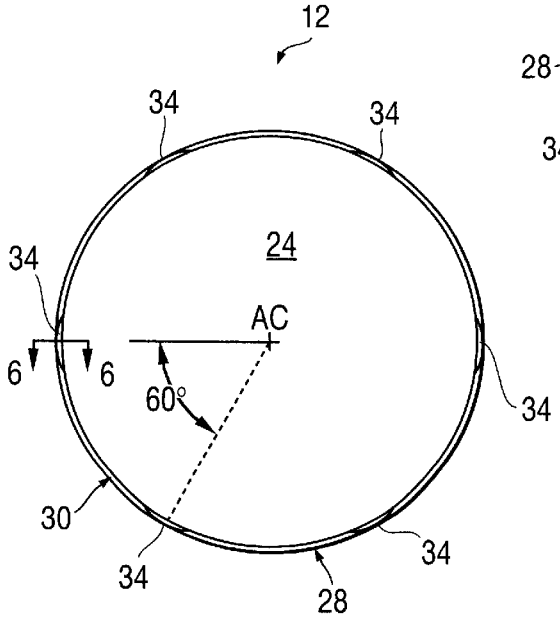
FIG. 4 is a detailed top view of one embodiment of a ceramic wear pad in accordance with the present invention.
Figure 5:
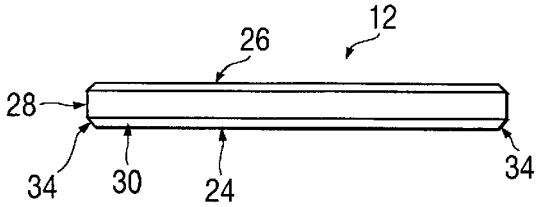
FIG. 5 is a side profile view of the ceramic wear pad of FIG. 4.

A ceramic wear pad 12 having another rotation prevention means is illustrated in FIGS. 4 and 5, the common features of the ceramic wear pad 12 being enumerated using the same numerals as the above discussed embodiment for clarity. In this embodiment, the rotation prevention means also includes a plurality of engagement surfaces 34 distributed along the peripheral edge surface 28 of the ceramic wear pad 12. As clearly shown in FIG. 5, because the peripheral edge surface 28 includes a beveled edge 30, the plurality of engagement surfaces 34 are provided on the beveled edge 30. Furthermore, as evident in FIG. 4, the illustrated embodiment provides six evenly distributed engagement surfaces 34 that are equidistantly positioned at every 60° along the peripheral edge surface 28.

Figure 6:
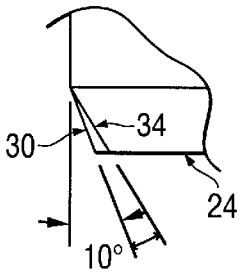
FIG. 6 is a cross-sectional profile view of the engagement surface of the ceramic wear pad of FIG. 4 as viewed along 6—6.

As can be seen in the enlarged view of FIG. 6, the engagement surfaces 34 may be at an angle which is different than either the peripheral edge surface 28, or in this embodiment, the beveled edge 30. These engagement surfaces may be positioned on the peripheral edge surface 28 thereby providing surface variation in the curved surface of the peripheral edge surface and/or the beveled edge 30 which has a curvature due to the disk shape of the ceramic wear pad 12. In this regard, in the illustrated embodiment, the beveled edge 30 may be formed by a 20° face chamfer and the engagement surfaces 34 may be formed by a subsequent 30° pass with an end mill in an indexing head (not shown).

Figure 7:
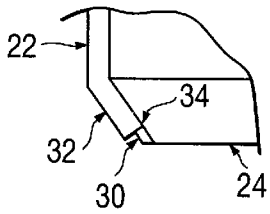
FIG. 7 is the cross-sectional profile view of FIG. 6 but also showing the inwardly angled portion of the peripheral lip.

By providing such engagement surfaces 34, variations in retaining of the ceramic wear pad 12 in the recessed pocket 20 by the inwardly angled portion 32 of the peripheral lip 22 as shown in FIG. 2 may be attained. In other words, as most clearly shown in FIG. 7, when the peripheral lip 22 is swaged radially inwardly all along its circumference to encapsulate the ceramic wear pad 12, the inwardly angled portion 32 of the peripheral lip 22 engages the engagement surfaces 34 as well as the peripheral edge surface 28 (in particular, the beveled edge 30 in this embodiment) so that engagement and encapsulation of the ceramic wear pad 12 occurs in numerous different planes and angles. Consequently, the inwardly angled portion 32 contacts the engagement surfaces 34 at a different plane than elsewhere on the peripheral edge surface 28 and prevents rotation of the ceramic wear pad 12 relative to the recessed pocket 20.

Of course, it should be appreciated that different numbers of engagement surfaces 34 may be provided arranged in a different distribution in other embodiments of the present invention. For example, four engagement surfaces 34 positioned at every 90° may be provided instead. Moreover, the engagement surfaces 34 provided may even be randomly distributed at various angles along the periphery of the ceramic wear pad 12. It should also be noted that even one engagement surface may suffice in providing a rotation prevention means. However, in the preferred embodiment, providing a plurality of evenly distributed engagement surfaces have been found to provide a more robust rotation prevention means in accordance with the present invention.

Figure 8:
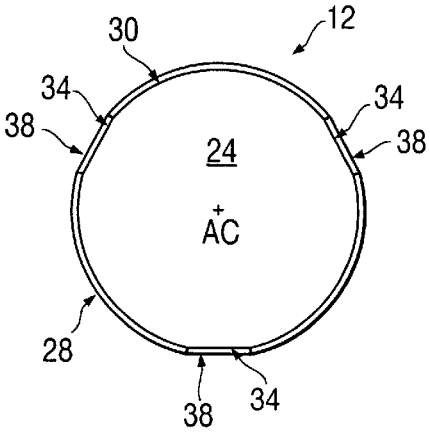
FIG. 8 is a top view of another embodiment of a ceramic wear pad in accordance with the present invention.

FIG. 8 illustrates a ceramic wear pad 12 having a rotation prevention means in accordance with yet another embodiment of the present invention. Again, the common features are numbered the same as in the prior embodiments. As can be clearly seen, like the previously discussed embodiment, the ceramic wear pad 12 is also provided with a plurality of engagement surfaces 34 distributed along the peripheral edge surface 28 of the ceramic wear pad 12. Like the previous embodiment, the ceramic wear pad 12 is provided with a beveled edge 30 so that the plurality of engagement surfaces 34 are provided on the beveled edge 30. However, in contrast to the previous embodiment, the plurality of engagement surfaces 34 extend across the thickness of the ceramic wear pad 12 so that flats 38 are provided on the curvature of the peripheral edge surface 28. Thus, in the illustrated embodiment of FIG. 8, three evenly distributed engagement surfaces 34 are equidistantly positioned at every 120° along the peripheral edge surface 28. Of course, it should again be appreciated that different numbers of engagement surfaces 34 may be provided arranged in a different distribution in other embodiments of the present invention.

As can be appreciated, the present embodiment can be used to retain the ceramic wear pad 12 in the recessed pocket 20 in the same manner as described relative to FIG. 4 so that when the peripheral lip 22 is swaged radially inwardly all along its circumference to encapsulate the ceramic wear pad 12, the inwardly angled portion 32 of the peripheral lip 22 engages the engagement surfaces 34 to prevent rotation of the ceramic wear pad 12 relative to the recessed pocket 20. However, in this embodiment, the flats 38 provide an added mechanism for the rotation prevention means in that it allows a set screw to be used.

Figure 9:
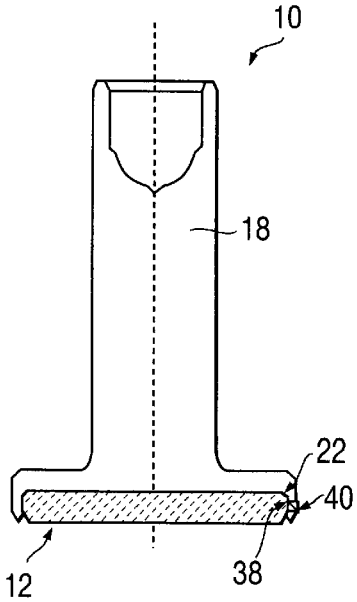
FIG. 9 is a cross-sectional view of another embodiment of a tappet assembly in accordance with the present invention including a set screw.

In particular, as can be seen in the embodiment of FIG. 9, the tappet body 18 may be provided with a set screw 40 threaded through a hole on the extended peripheral lip 22 so that the set screw 40 extends into the recessed pocket to fixably engage a flat 38 on the peripheral edge surface 28 of the ceramic wear pad 12 and prevent the rotation thereof. As can also be seen, in the illustrated embodiment of FIG. 9, the peripheral lip 22 is also swaged radially inwardly all along its circumference to encapsulate the ceramic wear pad 12 so that the inwardly angled portion 32 of the peripheral lip 22 engages the engagement surfaces 34 to prevent rotation of the ceramic wear pad 12 relative to the recessed pocket 20.

As an alternative variation to the embodiment illustrated in FIG. 9, a weldment (not shown) may be used instead of the setscrew 40 so that the weldment fills the space between the peripheral lip 22 and the flat 38 on the side of the ceramic wear pad 12 so that the ceramic wear pad 12 is prevented from rotating relative to the recessed pocket 20.

Figure 10:
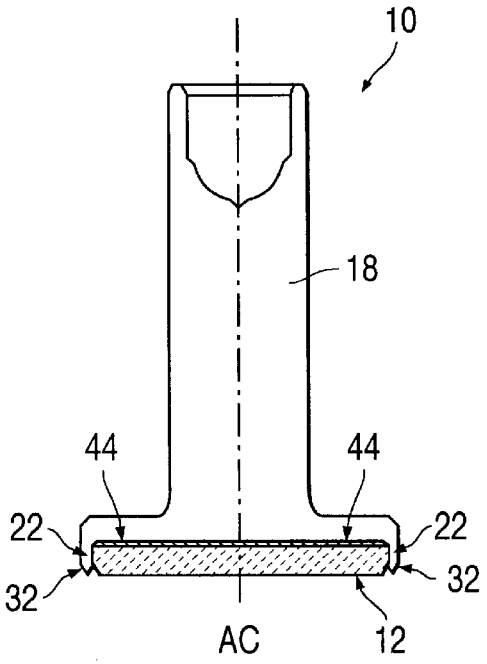
FIG. 10 is a cross-sectional view of another embodiment of a tappet assembly in accordance with the present invention including an adhesive layer.

Yet another embodiment of the present invention is illustrated in FIG. 10 where the tappet assembly 10 may further comprise an intermediary layer 44 disposed in the recessed pocket 20 between the bottom surface 26 of the ceramic wear pad 12 and the base surface 21 of the recessed pocket 20. In one embodiment, the intermediary layer 44 may be an adhesive for adhering the bottom surface 26 of the ceramic wear pad 12 to the base surface 21 so that it will not rotate relative to the recessed pocket 20. The adhesive also acts to minimize any localized contact stresses caused by surface irregularities of the ceramic wear pad 12 and the base surface 21 of the tappet body 18. Moreover, the adhesive also fills the gap between the ceramic wear pad 12 and the inwardly angled portion 32 caused by the elastic spring back of the peripheral lip 22. In this regard, the intermediary layer 44 may be made of epoxy or be formed of a dry polymer film which is adapted to be melted and resolidified.

Figure 11:
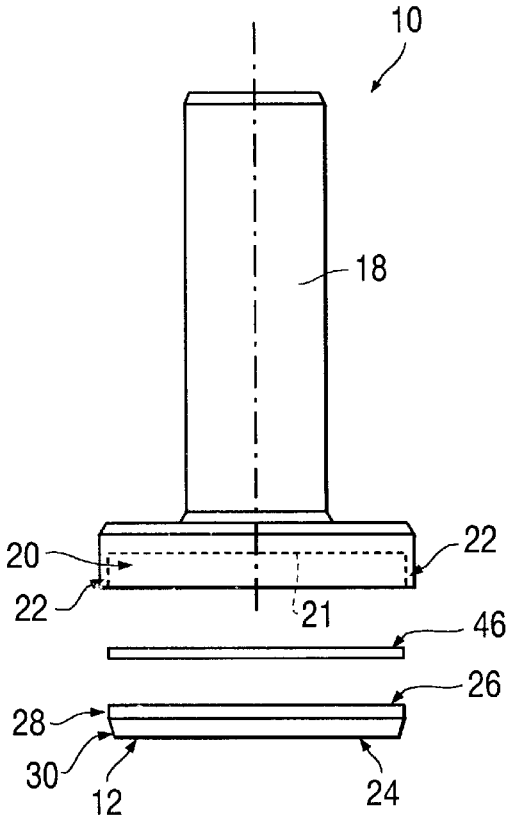
FIG. 11 is a cross-sectional view of another embodiment of a tappet assembly in accordance with the present invention including a compliant layer.

Alternatively, in another embodiment, the intermediary layer 44 may be a compliant layer 46 as shown in FIG. 11 and be made of a material which is more compliant than the tappet body 18 and the ceramic wear pad 12 so as to have a smaller modulus of elasticity than the tappet body 18 and the ceramic wear pad 12. For instance, if the tappet body IS is made of steel and the ceramic wear pad 12 is made of silicon nitride or Zirconia, the compliant layer 46 may be a metallic sheet, a metallic shim or a wire mesh and be made of aluminum, copper or other ductile material such as other metals or alloys, or be made of a polymer. Like the adhesive in the previous embodiment, such a compliant layer 46 also acts to minimize any localized contact stresses caused by surface irregularities of the ceramic wear pad 12 and the base surface 21 of the tappet body 18. In addition, the compliant layer 46 minimizes any gap between the ceramic wear pad 12 and the inwardly angled portion 32 caused by the elastic spring back of the peripheral lip 22. This is due to the fact that because the compliant layer 46 is more compliant than the tappet body is, when the peripheral lip 22 is swaged inwardly, the compliant layer 46 is compressed. As the peripheral lip 22 springs back a small amount, the compliant layer 46 also springs back a corresponding amount thereby eliminating the gap which may have otherwise been present. It should also be noted that whereas the illustrated embodiment, his intermediary layer 44 is disposed solely between the ceramic wear pad 12 and the base surface 21 of the tappet body 18, in other embodiments, the intermediary layer 44 can extend around the peripheral edge surface of the ceramic wear pad 12 to facilitate centering the ceramic wear pad 12 within the recessed pocket 20.

From the foregoing, it should now be apparent how the present invention provides an improved a tappet assembly with a ceramic wear pad which will allow increased engine performance and will increase the durability of the tappet assembly. As discussed above, the tappet assembly in accordance with the present invention overcomes the deficiencies of the prior art tappets by preventing the ceramic wear pad from sliding off the tappet body while also preventing the ceramic wear pad from rotating relative to the recessed pocket.

While various embodiments in accordance with the present invention have been shown and described, it is understood that the invention is not limited thereto. These embodiments may be changed, modified and further applied by those skilled in the art. For instance, as previously noted, the beveled edge need not be provided in various other embodiments and the arrangement of the engagement surfaces may be varied. In addition, the rotation prevention means may be implemented with the set screw feature by itself or together with the peripheral lip which has be swaged to provide an inwardly angled portion. Therefore, this invention is not limited to the details shown and described previously but also includes all such changes and modifications which are encompassed by the appended claims.

Industrial Applicability

The present invention will find applicability in a wide range of engines that use tappets and tappet assemblies where long term durability is desirable.

What is claimed is:

1. A tappet assembly for an internal combustion engine, said tappet assembly having a first end mechanically connected to a engine component and second end adapted to contact a cam lobe of a camshaft to displace said engine component, said tappet assembly comprising:

a tappet body having a recessed pocket positioned at one end thereof, said recessed pocket being defined by an extended peripheral lip of said tappet body;

a ceramic wear pad at least partially received within said recessed pocket, said ceramic wear pad being adapted to contact said cam lobe; and a rotation prevention means for preventing said ceramic wear pad from rotating relative to said recessed pocket.

2. The tappet assembly of claim 1, wherein said ceramic wear pad has a top surface for contacting said cam lobe, a bottom surface which is received in said recessed pocket, and a peripheral edge surface thereinbetween.

3. The tappet assembly of claim 2, wherein said rotation prevention means includes at least one inwardly angled portion of said peripheral lip, said at least one inwardly angled portion being swaged radially inwardly toward an axial center of said ceramic wear pad to engage said ceramic wear pad.

4. The tappet assembly of claim 3, wherein said ceramic wear pad has at least one engagement surface on said peripheral edge surface and said at least one inwardly angled portion engages said at least one engagement surface.

5. The tappet assembly of claim 4, wherein said at least one engagement surface is a plurality of engagement surfaces distributed along said peripheral edge surface and said at least one inwardly angled portion is a plurality of inwardly angled portions that engages said plurality of engagement surfaces.

6. The tappet assembly of claim 5, wherein said peripheral edge surface includes a beveled edge so that said top surface has a smaller diametric dimension than said bottom surface.

7. The tappet assembly of claim 6, wherein each of said plurality of engagement surfaces are equidistantly distributed on said beveled edge.

8. The tappet assembly of claim 2, wherein said peripheral edge surface includes a beveled edge so that said top surface has a smaller diametric dimension than said bottom surface.

9. The tappet assembly of claim 8, wherein said rotation prevention means includes a plurality of engagement surfaces on said beveled edge and a plurality of inwardly angled portions of said peripheral lip, said plurality of inwardly angled portions being swaged radially inwardly toward an axial center of said ceramic wear pad to engage said plurality of engagement surfaces.

10. The tappet assembly of claim 4, wherein said rotation prevention means includes set screw threaded through a hole provided on said extended peripheral lip to fixably engage said at least one engagement surface on said peripheral edge surface of said ceramic wear pad.

11. The tappet assembly of claim 2, wherein said rotation prevention means includes at least one substantially flat surface provided on said peripheral edge surface of said ceramic wear pad.

12. The tappet assembly of claim 11, wherein said rotation prevention means includes set screw threaded through a hole provided on said extended peripheral lip to fixably engage said at least one substantially flat surface on said peripheral edge surface of said ceramic wear pad.

13. The tappet assembly of claim 11, wherein said rotation prevention means includes a weldment positioned be between said peripheral lip and said flat surface on said peripheral edge surface in a manner to prevent said ceramic wear pad from rotating relative to said recessed pocket.

14. The tappet assembly of claim 2, wherein said ceramic wear pad is made from at least one of Zirconia, silicon nitride and a cermet.

15. The tappet assembly of claim 3, further comprising an intermediary layer disposed in said recessed pocket between said bottom surface of said ceramic wear pad and a base surface of said recessed pocket.

16. The tappet assembly of claim 15, wherein said intermediary layer is an adhesive layer for adhering said bottom surface of said ceramic wear pad to said base surface of said recessed pocket.

17. The tappet assembly of claim 16, wherein said adhesive layer is made of epoxy.

18. The tappet assembly of claim 16, wherein said adhesive layer is formed of a dry polymer film which is adapted to be melted and resolidified.

19. The tappet assembly of claim 15, wherein said intermediary layer is a compliant layer made of a material which is more compliant than said tappet body and said ceramic wear pad.

20. The tappet assembly of claim 19, wherein said compliant layer is made of a material having a smaller modulus of elasticity than said tappet body and said ceramic wear pad.

21. The tappet assembly of claim 19, wherein said compliant layer is at least one of a metallic sheet, a metallic shim, a wire mesh, and made of a polymer.

22. The tappet assembly of claim 21, wherein said at compliant layer is made of at least one of aluminum and copper.

23. The tappet assembly of claim 21, wherein said intermediary layer extends around said peripheral edge surface of said ceramic wear pad to facilitate centering of said ceramic wear pad within said recessed pocket.

24. A tappet assembly for an internal combustion engine, said tappet assembly having a first end mechanically connected to a engine component and second end adapted to contact a cam lobe of a camshaft to displace said engine component, said tappet assembly comprising:

a tappet body having a recessed pocket positioned at one end thereof, said recessed pocket being defined by an extended peripheral lip of said tappet body;

a ceramic wear pad at least partially received within said recessed pocket, said ceramic wear pad having a top surface for contacting said cam lobe, a bottom surface which is received in said recessed pocket, and a peripheral edge surface thereinbetween, said peripheral edge surface including a beveled edge with a plurality of engagement surfaces; and wherein said extended peripheral lip is swaged radially inwardly toward an axial center of said ceramic wear pad to engage said plurality of engagement surfaces on said beveled edge, and to prevent rotation of said ceramic wear pad relative to said recessed pocket.

25. The tappet assembly of claim 24, wherein said ceramic wear pad is made from at least one of Zirconia, silicon nitride and a cermet.

26. The tappet assembly of claim 24, further comprising an intermediary layer disposed in said recessed pocket between said bottom surface of said ceramic wear pad and a base surface of said recessed pocket.

27. The tappet assembly of claim 26, wherein said intermediary layer is an adhesive layer of epoxy for adhering said bottom surface of said ceramic wear pad to said base surface of said recessed pocket.

28. The tappet assembly of claim 26, wherein said adhesive layer is formed of a dry polymer film which is adapted to be melted and resolidified.

29. The tappet assembly of claim 26, wherein said intermediary layer is a compliant layer made of a material which is more compliant than said tappet body and said ceramic wear pad.

30. The tappet assembly of claim 29, wherein said compliant layer is at least one of a metallic sheet, a metallic shim, a wire mesh, and made of a polymer.

31. The tappet assembly of claim 30, wherein said at compliant layer is made of at least one of aluminum and copper.

* * * * *